US008118603B2

(12) United States Patent
Ho

(10) Patent No.: US 8,118,603 B2
(45) Date of Patent: Feb. 21, 2012

(54) ELECTRICAL CONNECTOR

(75) Inventor: Chien Chih Ho, Keelung (TW)

(73) Assignee: Lotes Co., Ltd., Keelung (TW)

( * ) Notice: Subject to any disclaimer, the term of this patent is extended or adjusted under 35 U.S.C. 154(b) by 42 days.

(21) Appl. No.: 12/721,926

(22) Filed: Mar. 11, 2010

(65) Prior Publication Data

US 2011/0223781 A1 Sep. 15, 2011

(51) Int. Cl.
*H01R 12/00* (2006.01)

(52) U.S. Cl. ..... 439/70; 439/626

(58) Field of Classification Search ..... 436/70, 436/862, 630; 439/70–71, 630, 862
See application file for complete search history.

(56) References Cited

U.S. PATENT DOCUMENTS 7,291,021 B2 * 11/2007 Shirai et al. ..... 439/71
7,517,261 B2 * 4/2009 Wan et al. ..... 439/862
7,803,011 B1 * 9/2010 Mai ..... 439/500
7,922,548 B2 * 4/2011 Fan ..... 439/862
2008/0171478 A1 * 7/2008 Tsai ..... 439/862
* cited by examiner

*Primary Examiner* — Renee Luebke
*Assistant Examiner* — Larisa Tsukerman
(74) *Attorney, Agent, or Firm* — Kile Goekjian Reed & McManus PLLC

(57) ABSTRACT

An electrical connector includes an insulting main body having a plurality of receiving holes, and a plurality of pins located in the receiving holes. Each pin has a base portion, a welding portion and a flexible arm. The flexible arm has a first bend portion bent and extended upwards from the base portion, a second bend portion bended from the first bend portion, a first yield space above the second bend portion, a third bend portion bent slantedly and extended upwards from the second bend portion and a second yield space below the third bend portion. A contact portion is located at the end of the flexible arm. Due to the pin structure with the first yield space and the second yield space, the two flexible arms will not easily contact each other to prevent the short circuit problem or the interference problem from occurring.

20 Claims, 7 Drawing Sheets

ELECTRICAL CONNECTOR

BACKGROUND OF THE INVENTION

1. Field of the Invention

The present invention relates to an electrical connector. In particular, the present invention relates to an electrical connector with pins that can prevent the short-circuit problem from occurring.

2. Description of Related Art

Reference is made to FIGS. 1 and 2. The electrical connector of the prior art includes an insulating main body (a) and a plurality of conducting pins (b). The insulating main body (a) has a plurality of receiving holes (a1) that are disposed in the lengthwise direction and the lateral direction. The conducting pins (b) are respectively installed in the receiving holes (a1). Each of the conducting pins (b) has a base portion (b1). The base portion (b1) is located in the receiving hole (a1). A flexible arm (b2) extends upwards from the base portion (b1). A welding portion (not shown in the figure) extends downwards from the base portion (b1). The flexible arm (b2) further includes a bending portion (b21) that extends and bends upwards from one end of the base portion (b1) and part of the bending portion (b21) extends outside of the receiving hole (a1). A connection portion (b22) slantedly bends and extends upwards from the bending portion (b21). A contact portion (b23) is located at the end of the connection portion (b22).

The electrical connector is electrically connected with a chip (c) located above the electrical connector and a circuit board (not shown in the figure) located below the electrical connector. When the chip (c) is installed on the insulating main body (a), the chip (c) presses and contacts the contact portion (b23) of the conducting pins (b). At this time, when the conducting pins (b) are located in the same lengthwise row and adjacent, the flexible arm (b2) of one conducting pin (b) is located above the flexible arm (b2) of another conducting pin (b), the contact portion (b23) of one conducting pin (b) is located above the connection portion (b22) of another conducting pin (b), and the bend portion (b21) of another conducting pin (b) is located below the connection portion (b22) of one conducting pin (b). By utilizing the conducting pin (b), the chip (c) and the circuit board perform the signal transmission well.

The drawbacks of the electric connector are:

1. When the chip is pressed to contact the conducting pins, the flexible arm of one conducting pin is located above the flexible arm of another conducting pin, the contact portion of one conducting pin is located above the connection portion of another conducting pin, the bend portion of another conducting pin is located below the connection portion of one conducting pin and there is no yield space or separating structure, the flexible arms of the conducting pins that are located in the same lengthwise row and adjacent easily contact to each other. The short circuit problem occurs.

2. The connection portion extends upwards from the bend portion directly. Comparing with a connection portion slants downwards a predetermined distance from the bend portion and then is curved and extended upwards, the conducting pin is easily bent when the chip is pressed to contact the contact portion of the conducting pin.

3. Because the connection portion extends upwards from the bend portion, the press distance of the flexible arm is larger. After the conducting pin is pressed many times, the conducting pin is easily fatigued. The contact between the chip and the contact portion will be instable.

SUMMARY OF THE INVENTION

One particular aspect of the present invention is to provide an electrical connector that has a yield space for preventing the short circuit problem from occurring and solves the pin-bend problem and the fatigued problem.

The electrical connector is used for connecting a chip. The electrical connector includes an insulting main body, and a plurality of pins. The insulting main body has a plurality of receiving holes, and the receiving holes are disposed in the insulting main body in at least one row. The pins are located in the receiving holes. Each pin has a base portion located in the receiving hole, a welding portion extends downwards from the base portion, a flexible arm having a first bend portion that bends and extends upwards from the base portion, a second bend portion that bends from the first bend portion, part of the second bend portion extends out of the receiving hole and above the second bend portion, there is a first yield space, a third bend portion that slantedly bends and extends upwards from the second bend portion and below the third bend portion, there is a second yield space, a contact portion located at the end of the flexible arm and corresponding to the chip. When the chip is pressed to contact the contact portion of the pins, the flexible arm of one pin is located above the flexible arm of another pin, the contact portion of one pin is located above the first yield space of another pin, and the first bend portion of another pin is located below the second yield space of one pin for the two pins that are located in the same lengthwise row and adjacent.

For the two pins that are located in the same lengthwise row and adjacent, the flexible arm of one pin is located above the flexible arm of another pin, the contact portion of one pin is located above the first yield space of another pin, and the first bend portion of another pin is located below the second yield space of one pin. When the chip is pressed to contact the contact portion, the contact portion of one pin is located in the first yield space of another pin and the first bend portion of another pin is located in the second yield space of one pin so that the flexible arms of the two pins will not contact each other. The short circuit problem or the interference problem is avoided.

Furthermore, because the flexible arm has a second bend portion bent from the first bend portion, the third bend portion slantedly bends and extends upwards from the second bend portion, and the end of the flexible arm has the contact portion, the slope of the flexible arm is smaller than the slope of the first bend portion directly bending and extending to form the contact portion. Therefore, when the pin is pressed, the flexible arm will not be easily bent. The press distance of the pin is also reduced by this structure. When the pin is pressed many times, the flexible arm will not be easily fatigued. The usage life of the pin is improved.

For further understanding of the present invention, reference is made to the following detailed description illustrating the embodiments and examples of the present invention. The description is for illustrative purpose only and is not intended to limit the scope of the claim.

DETAILED DESCRIPTION OF THE PREFERRED EMBODIMENTS

Figure 1:
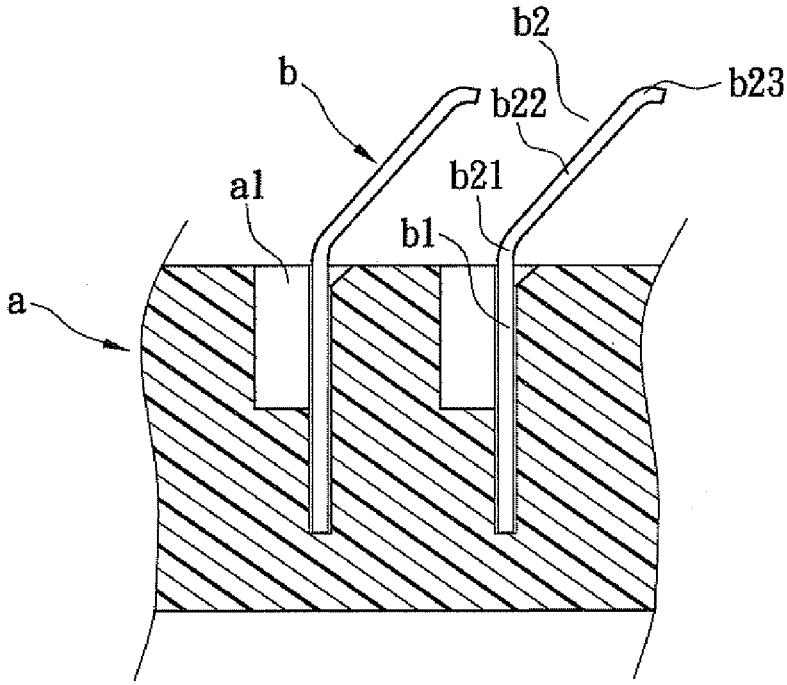
FIG. 1(PRIOR ART)
FIG. 1 is a schematic diagram of part of the electrical connector of the prior art.
Figure 2:
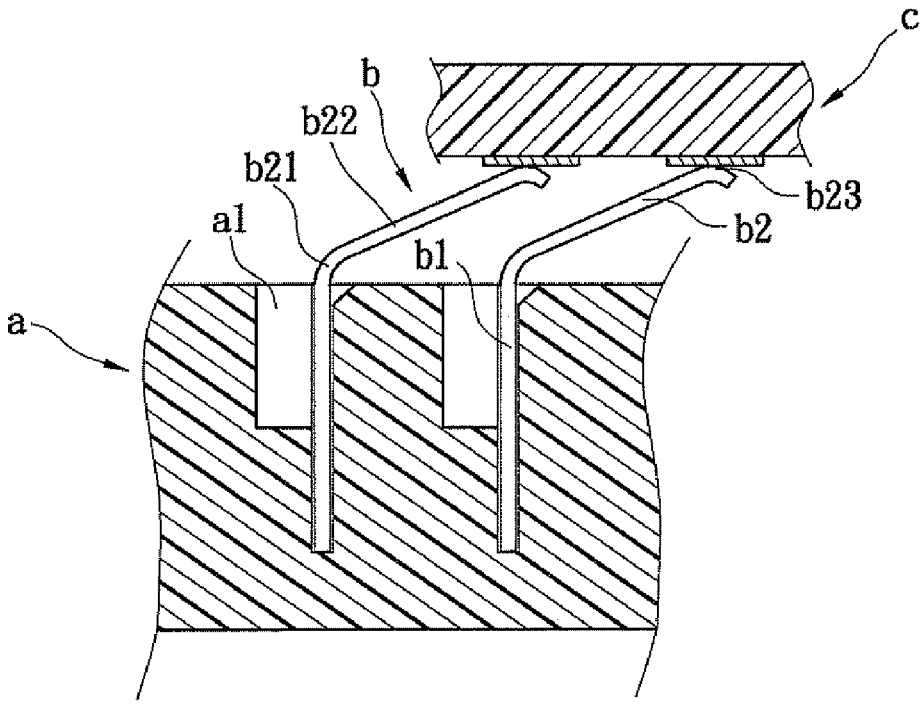
FIG. 2(PRIOR ART)
FIG. 2 is a schematic diagram of part of the electrical connector being pressed by a chip of the prior art.
Figure 3:
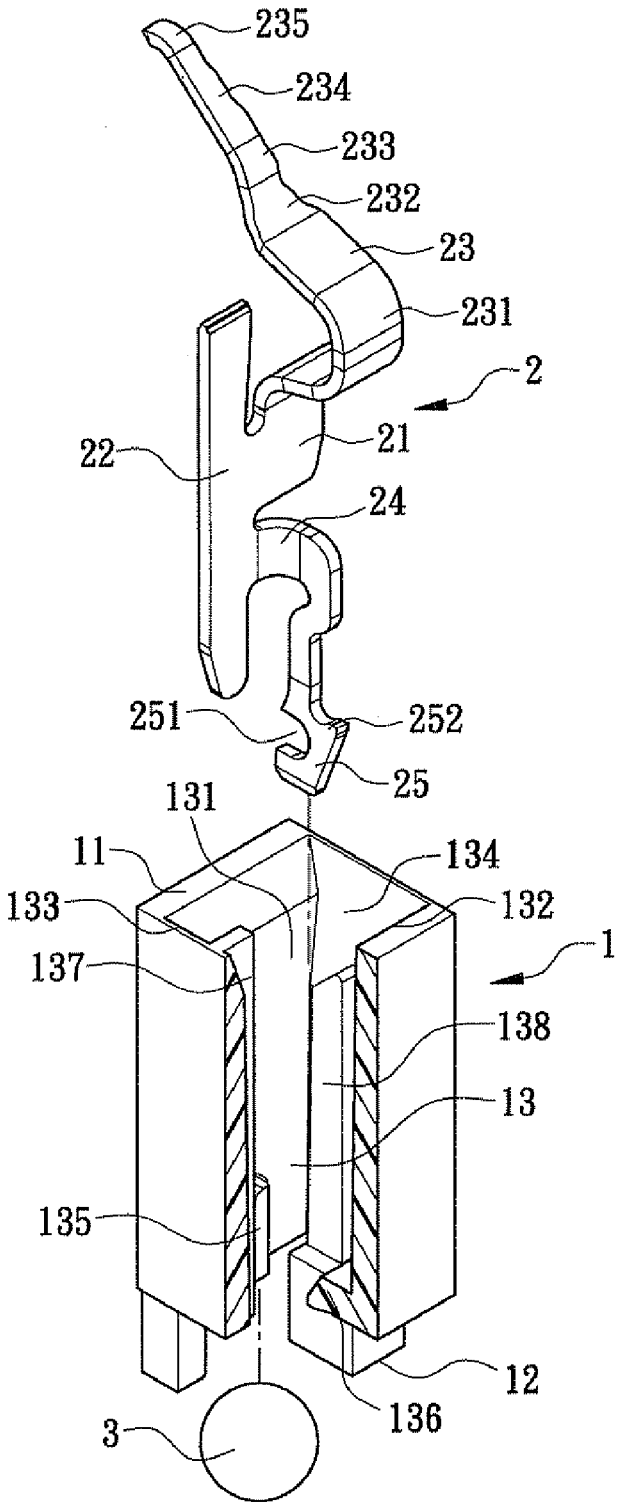
FIG. 3 is an exploded perspective view of the receiving hole and the pin of the electrical connector of the present invention.

Reference is made to FIG. 3. The electrical connector includes an insulating main body 1, a plurality of pins 2 located in the insulating main body 1, and a plurality of soldering balls 3 corresponding to the pins 2.

Figure 5:
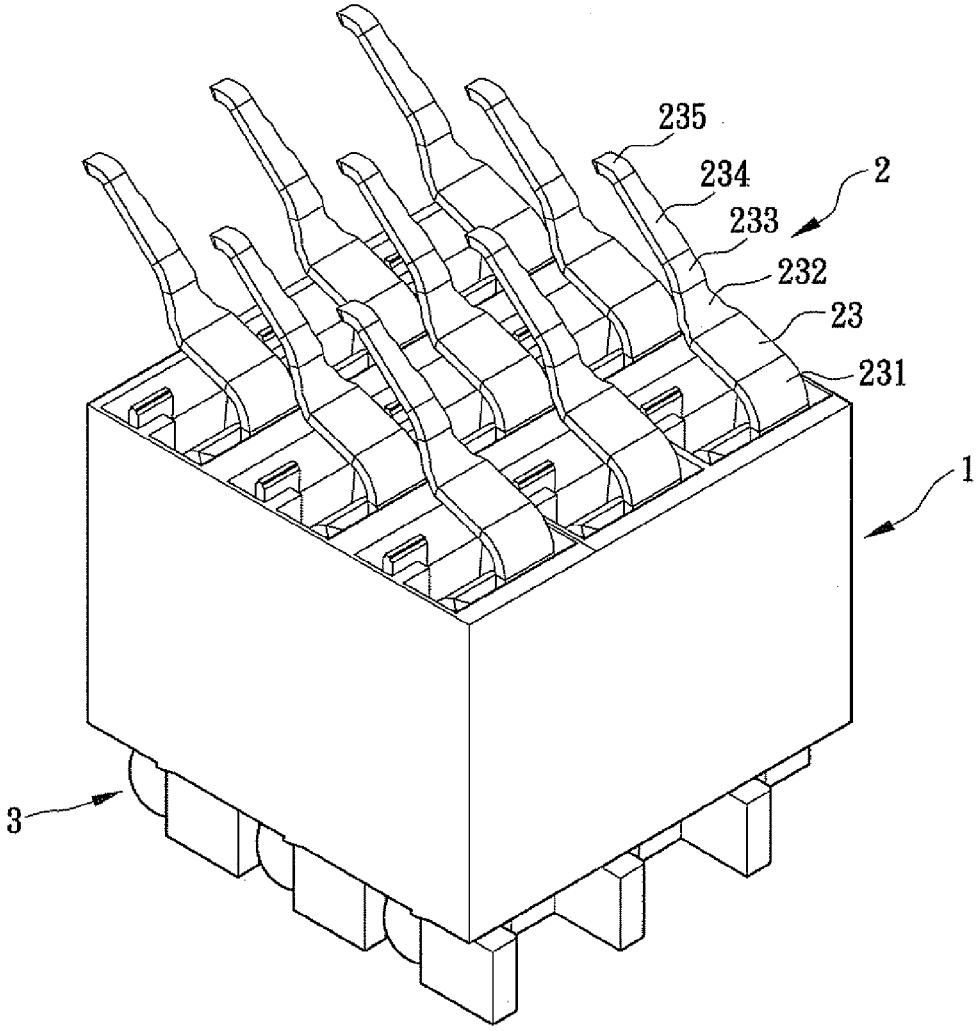
FIG. 5 is an assembly perspective view of the electrical connector and the pin of the present invention.
Figure 6:
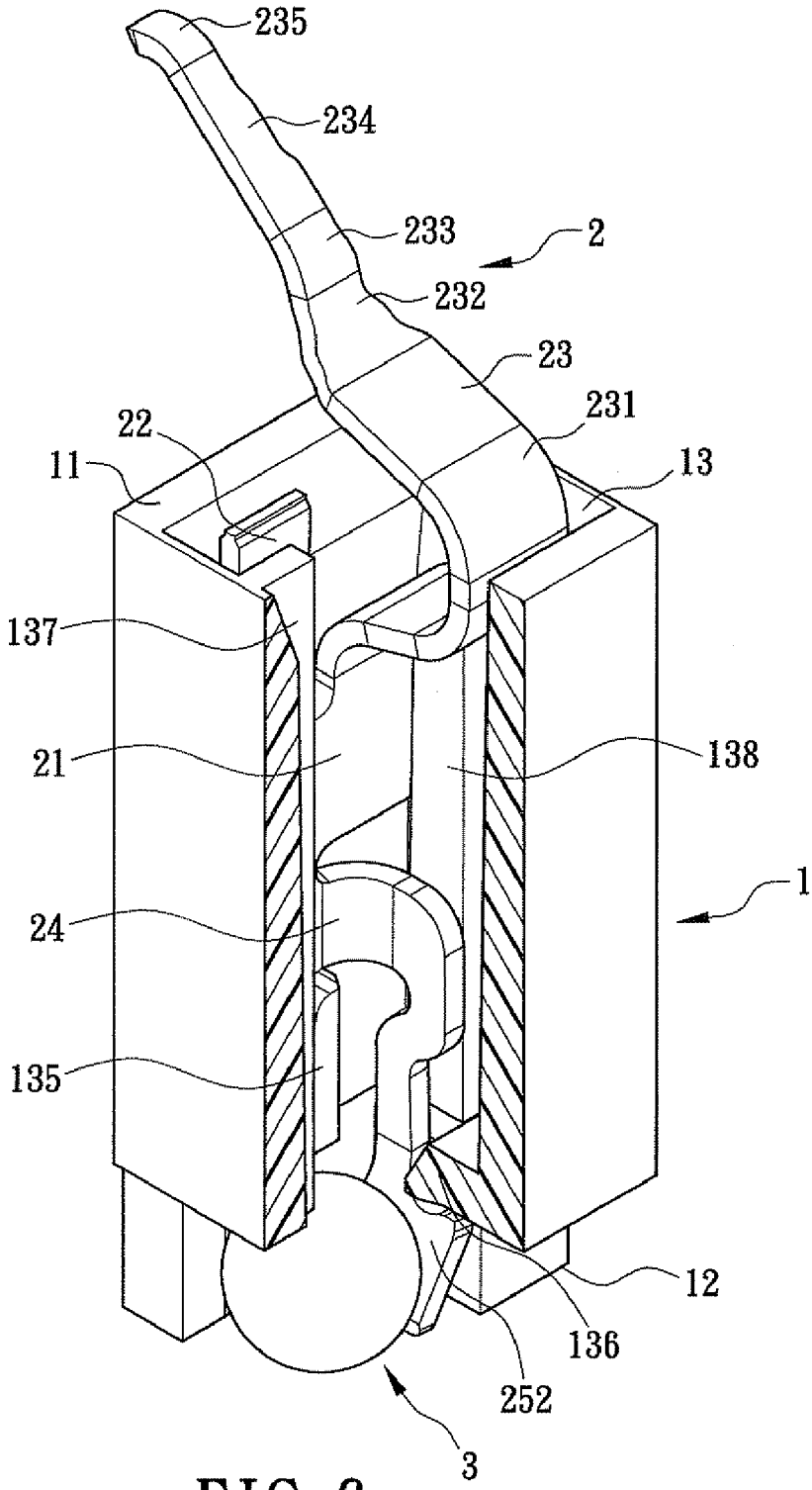
FIG. 6 is a cross-sectional diagram of part of the receiving hole and the pin of the electrical connector be assembled of the present invention.
Figure 7:
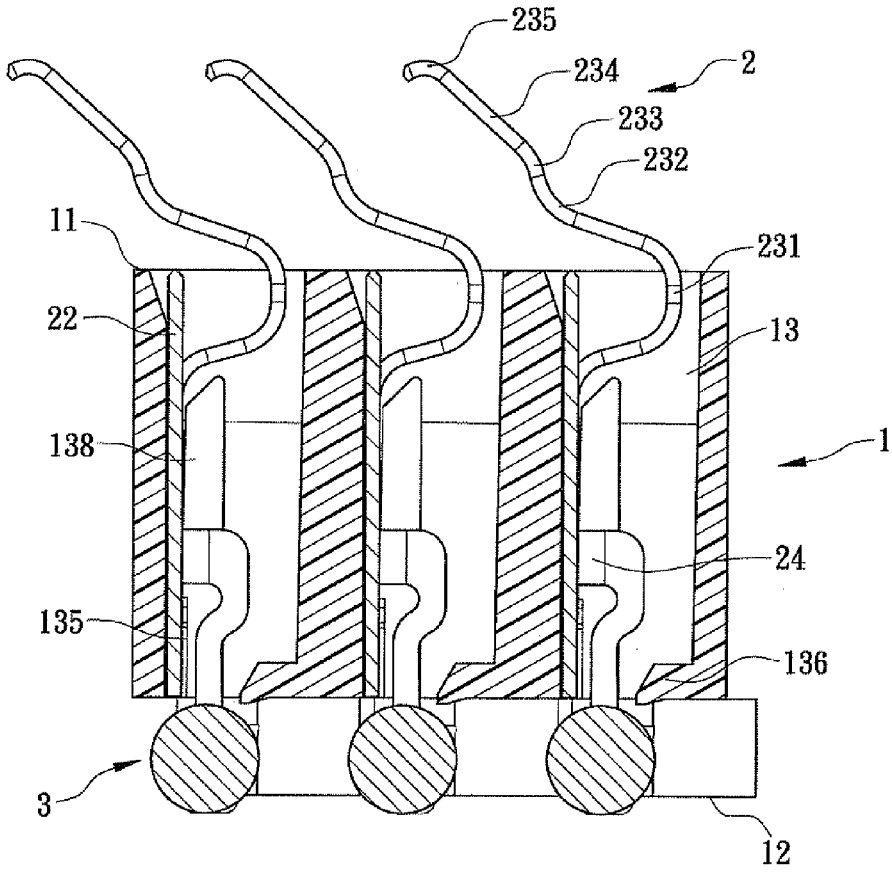
FIG. 7 is a cross-sectional diagram of FIG. 5.
Figure 8:
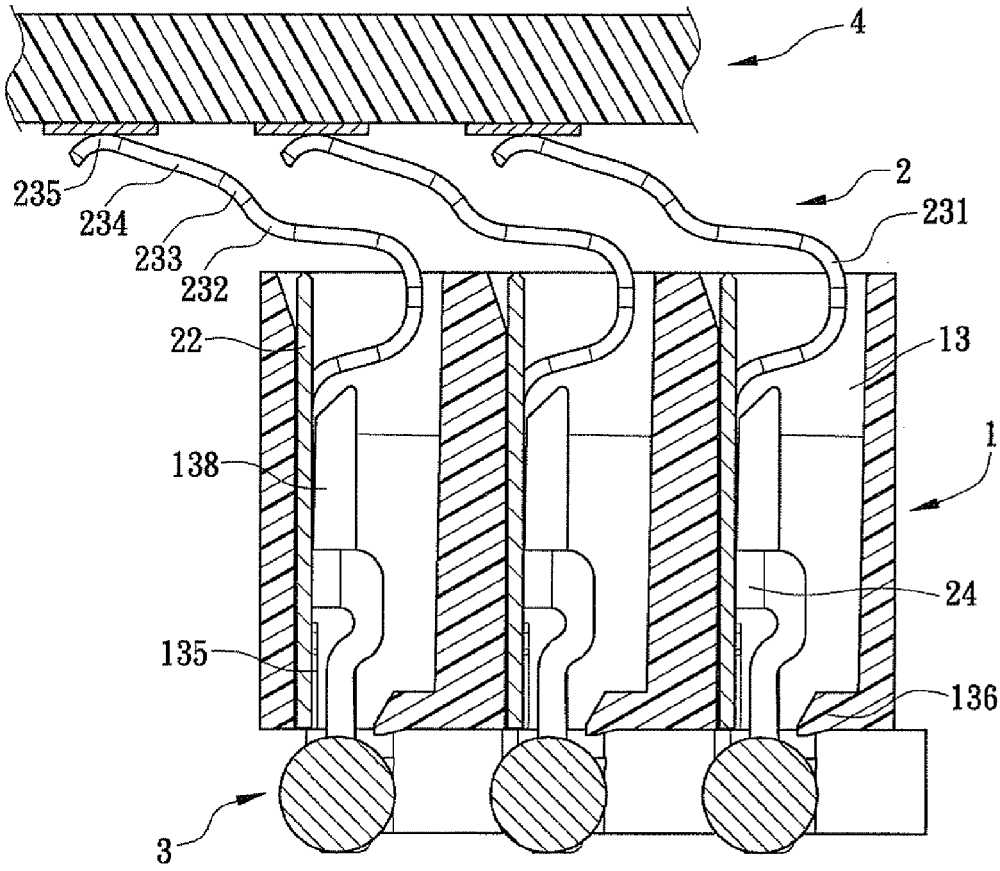
FIG. 8 is a cross-sectional diagram of the pins being pressed by the chip of the present invention.

Reference is made to FIGS. 3 and 5. The insulating main body 1 has an upper surface 11 and a lower surface 12, and a plurality of receiving holes 13 that pass through the upper surface 11 and the lower surface 12 (in this embodiment, the receiving holes 13 are disposed in a plurality of rows in the lengthwise direction and the lateral direction. for other embodiments, the receiving holes 13 can be disposed in slant rows or other ways). Each receiving hole 13 has a front inner wall 131 and a rear inner wall 132, and a left inner wall 133 and a right inner wall 134. The front inner wall 131 that is close to the middle of the lower surface 12 protrudes to faun a first positioning portion 135. The rear inner wall 132 that is close to the lower surface 12 has a second positioning portion 136. The middle of the left inner wall 133 and the right inner wall 134 respectively have a third positioning portion 137 and a fourth positioning portion 138 that are lengthwise-shaped.

Figure 4:
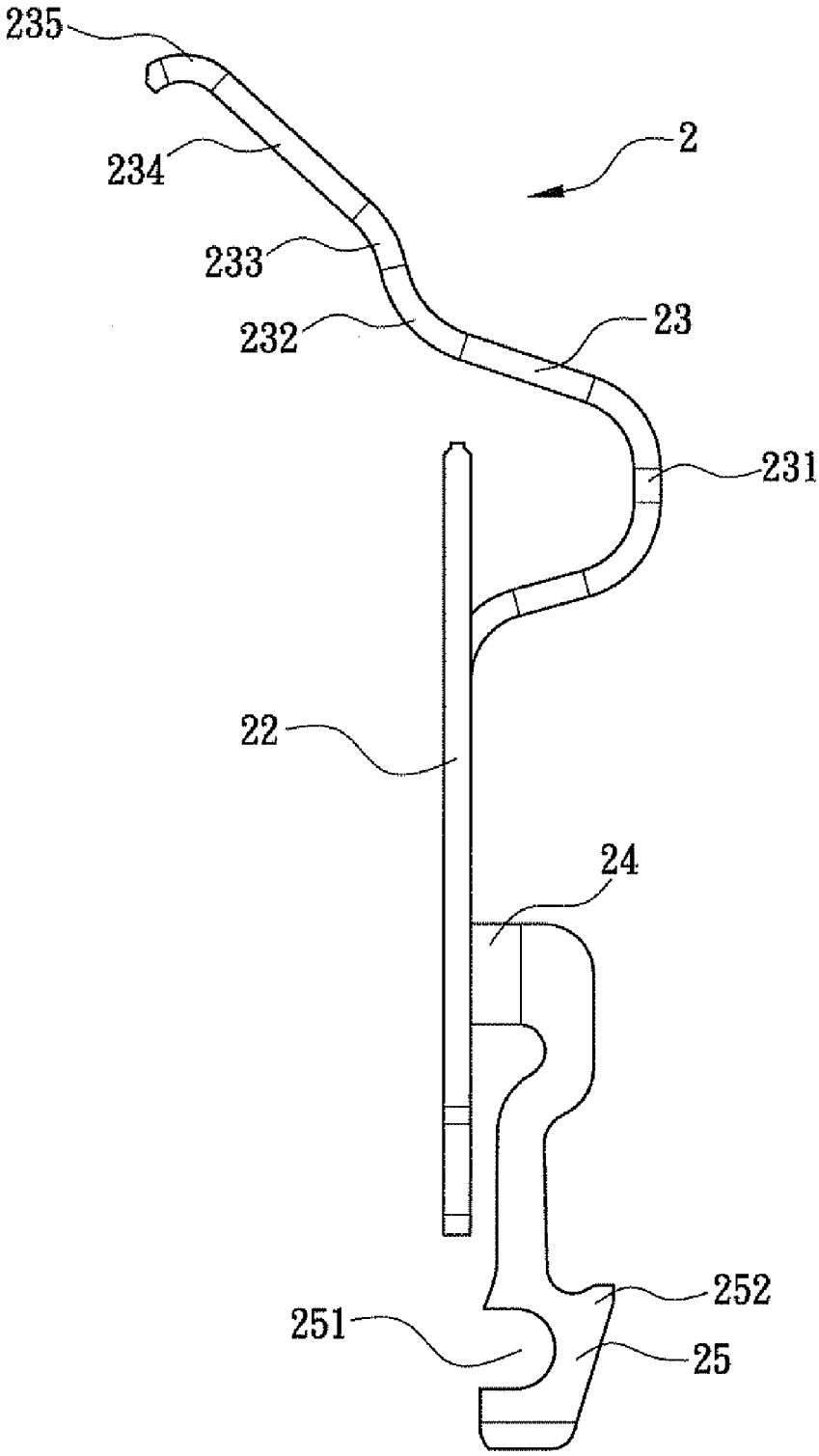
FIG. 4 is a side view of the pin of the electrical connector of the present invention.

Reference is made to FIGS. 3 and 4. Each of the pins 2 has a base portion 21, a holding portion 22, a flexible arm 23, a transition portion 24, and a welding portion 25. The base portion 21 is located in the receiving hole 13 and matches the fourth positioning portion 138. The holding portion 22 extends from one side of the base portion 21 and matches the third positioning portion 137. The base portion 21 and the holding portion 22 are located in the common plane. The flexible arm 23 bends and extends upwards and forwards from the base 21, and part of the flexible arm 23 extends outside of the receiving hole 13. The transition portion 24 bends and extends downwards from one side of the holding portion 22 that is close to the base portion 21, and the transition portion 24 matches the first positioning portion 135. The welding portion 25 extends downwards from the transition portion 24. One side of the welding portion 25 that is close to the base portion 21 has a concave trough 251, and another side of the welding portion 25 has an inversed book 252. The inversed hook 252 matches the second positioning portion 136.

The flexible arm 23 further has a first bend portion 231, a second bend portion 232, a third bend portion 233, a connection portion 234, and a contact portion 235. The first bend portion 231 bends and extends upwards and backwards from the base portion 21. The second bend portion 232 bends and extends forwards from the first bend portion 231, above the second bend portion 232, there is a first yield space (not labeled) and the second bend portion 232 has a first bend point (not labeled). The third bend portion 233 slantedly bends and extends upwards and forwards from the second bend portion 232, below the third bend portion 233, there is a second yield space (not labeled), and the third bend portion 233 has a second bend point (not labeled). The connection portion 234 extends forwards from the third bend portion 233. The contact portion 235 is located at the end of the connection portion 234, and has a third bend point (not labeled). The first bend point and the third bend point forms a dash line (not shown in the figure). The second bend point is located above the dash line.

Reference is made to FIGS. 5-8. The electrical connector is used for electrical conducting a chip 4 and a circuit board (not shown in the figure) so that the chip 4 is electrically conducted with the circuit board well.

Firstly, the pins 2 are respectively installed in the corresponding receiving holes 13 of the insulating main body 1 from top to bottom. The second positioning portion 136 is located above the inversed hook 252 for blocking the pin 2 to move upwards. The first positioning portion 135 is located below the transition portion 24 for blocking the pin 2 to move downwards. The base portion 21 is wedged between the fourth positioning portion 138 and the front inner wall 131 for limiting the movement of the pin 2 in the front and back directions. The holding portion 22 is wedged between the third positioning portion 137 and the front inner wall 131 for limiting the movement of the pin 2 in the front and back directions. Part of the flexible arm 23 extends outside of the upper surface 11 of the insulating main body 1.

Next, the soldering balls 3 are installed into the corresponding receiving holes 13 from the bottom up. The soldering ball 3 is adjacent to the concave trough 251 of the welding portion 25, and is close to the lower surface 12 of the insulating main body 1.

The assembled electrical connector is welded onto the circuit board. By using the soldering balls 3, the welding portion 25 is welded on the circuit board well.

Finally, the chip 4 is installed on the insulting main body 1 of the electrical connector. When the chip 4 is pressed to contact the contact portion 235 of the pin, the flexible arm 23 of the pin 2 located in the rear row is located above the flexible arm 23 of the pin 2 located in the front row, the contact portion 235 of the pin 2 located in the rear row is located in the first yield space of the pin 2 located in the front row, and the first bend portion 231 of the pin 2 located in the front row is located in the second yield space of the pin 2 located in the rear row for two pins 2 that are located in the same lengthwise row and adjacent. Thereby, the pins 2 can transmit signal well between the chip 4 and the circuit board.

The electrical connector of the present invention has the following advantages.

1. Part of the flexible arm of the pin located in the rear row is located above the flexible arm of the pin located in the front row for two pins that are located in the same lengthwise row and adjacent, above the second bend portion, there is a first yield space, and below the third bend portion, there is a second yield space. When the chip is pressed to contact the contact portion, the contact portion of the pin located in the rear row is located in the first yield space of the pin located in the front row, and the first bend portion of the pin located in the front row is located in the second yield space of the pin located in the rear row. Therefore, the flexible arm of the pin located in the front row will not easily contact the flexible arm of the pin located in the rear row. The short circuit problem and the interference problem are avoided.

2. Because the flexible arm has a second bend portion bent from the first bend portion, the third bend portion slantedly bends and extends upwards from the second bend portion, the connection portion extends forwards from the third bend portion, and the end of the connection portion has the contact portion, the slope of the flexible arm is smaller than the slope of the first bend portion being directly bent and extended to form the contact portion. Therefore, when the pin is pressed, the flexible arm will not be easily bent. The press distance of the pin is also reduced by this structure. When the pin is pressed many times, the flexible arm will not be easily fatigued. The usage life of the pin is improved.

3. The welding portion has a concave trough. When the electrical connector is welded onto the circuit board, the contact area of the soldering ball and the welding portion becomes larger and the concave trough is embedded into the interior of the soldering ball to achieve the stable effect. Thereby, the electrical connector is welded with the circuit board well.

The description above only illustrates specific embodiments and examples of the present invention. The present invention should therefore cover various modifications and variations made to the herein-described structure and operations of the present invention, provided they fall within the scope of the present invention as defined in the following appended claims.

What is claimed is:

1. An electrical connector, used for connecting a chip, comprising:

an insulting main body having a plurality of receiving holes arranged in at least one row; and a plurality of pins respectively located in the receiving holes, wherein each of the pins comprises:

a base portion located in one of the receiving holes correspondingly;

a welding portion extending downwards from the base portion;

a flexible arm having a first bend portion that bends and extends upwards from the base portion, a second bend portion that bends from the first bend portion, part of the second bend portion extends out of the receiving hole and defining a first yielding space above the second bend portion, a third bend portion that slantedly bends and extends upwards from the second bend portion and defining a second yielding space below the third bend portion, and a contact portion located at the end of the flexible arm and corresponded to the chip;

wherein each of the receiving holes is defined by at least one inner wall, wherein at least one positioning portion is protruded from the at least one inner wall;

wherein each pin includes a holding portion extended from one side of the base portion, and a transition portion is formed and bent in the side direction from one side of the holding portion that is close to the base portion;

wherein the transition portion is positioned with the at least one positioning portion to limit the relative movement of the pin in the receiving hole:

wherein, when the chip is pressed to contact the contact portions of the pins, the flexible arm of one pin is located above the flexible arm of another pin, the contact portion of one pin is located above the first yielding space of another pin, and the first bend portion of another pin is located below the second yielding space of one pin for the two pins that are located in the same row and adjacent.

2. The electrical connector as claimed in claim 1, wherein the first bend portion bends and extends backwards from the base portion.

3. The electrical connector as claimed in claim 1, wherein the receiving holes are arranged in a plurality of rows, the receiving holes are arranged in a longitudinal direction and a transverse direction, and wherein the same row is the receiving holes arranged in the rows of said longitudinal direction.

4. The electrical connector as claimed in claim 1, wherein the base portions of the two pins that are located in the same row and adjacent are parallel to each other.

5. The electrical connector as claimed in claim 1, wherein the contact portion and the first bend portion are respectively located at two sides of the base portion from a predetermined side view.

6. The electrical connector as claimed in claim 1, wherein the at least one inner wall defining the receiving hole includes a front inner wall, a rear inner wall, a left inner wall and a right inner wall, wherein the at least one positioning portion includes a first positioning portion protruded from the front inner wall and a second positioning portion protruded from the rear inner wall a third positioning portion protruded from the left inner wall and a fourth positioning portion protruded from the right inner wall.

7. The electrical connector as claimed in claim 6, wherein one side of the welding portion has an inversed hook, the inversed hook is positioned with the second positioning portion for limiting the pin to move up.

8. The electrical connector as claimed in claim 6, wherein the base portion is positioned with the fourth positioning portion, the holding portion is positioned with the third positioning portion to limit the pin to move in the front and back directions.

9. The electrical connector as claimed in claim 8, wherein the base portion and the holding portion are located at the same plane.

10. The electrical connector as claimed in claim 8, wherein the transition portion is positioned with the first positioning portion to limit the pin to move downwards.

11. The electrical connector as claimed in claim 10, wherein the welding portion extends downwards from the transition portion, one side of the welding portion has an inversed hook, and the inversed hook is positioned with the second positioning portion to limit the pin to move upwards.

12. The electrical connector as claimed in claim 10, wherein one side of the welding portion has a concave trough.

13. An electrical connector, comprising:

an insulting main body having a plurality of receiving holes arranged, in at least one row; and a plurality of pins respectively located in the receiving holes, wherein each of the pins comprises:

a base portion located in one of the receiving holes correspondingly;

a welding portion extending downwards from the base portion;

a flexible arm having a bend portion, a first bend point, a second bend point and a third bend point from the bottom up, wherein the shortest distance between the first bend point and the third bend point is defined as a dash line, and the second bend point is located above the dash line;

wherein each of the receiving holes is defined by at least one inner wall, wherein at least one positioning portion is protruded from the at least one inner wall respectively;

wherein each pin includes a holding portion extended from one side of the base portion, and a transition portion is formed and bent in the side direction from one side of the holding portion that is close to the base portion;

wherein the transition portion is positioned with the at least one positioning portion to limit the relative movement of the pin in the receiving hole.

14. The electrical connector as claimed in claim 13, wherein the flexible arm of one pin is located above the flexible arm of another pin for two pins that are located in the same row and adjacent, and when the pins are pressed to a pre-determined position, the third bend point of one pin is located above the first bend point of another pin.

15. The electrical connector as claimed in claim 13, wherein the flexible arm of one pin is located above the flexible arm of another pin for two pins that are located in the same row and adjacent, and when the pins are pressed to a pre-determined position, the second bend point of one pin is located above the bend portion of another pin.

16. The electrical connector as claimed in claim 13, wherein the bend portion bends and extends forwards from the base portion.

17. The electrical connector as claimed in claim 13, wherein the receiving holes are arranged in a plurality of rows, the receiving holes are arranged in a longitudinal direction and a transverse direction, and wherein the same row is the receiving holes arranged in the rows of said longitudinal direction.

18. An electrical connector, comprising:

an insulting main body having a plurality of receiving holes arranged, in at least one row; and a plurality of pins respectively located in the receiving holes, wherein each of the pins comprises;

a base portion located in one of the receiving holes correspondingly;

a welding portion extending downwards from the base portion;

a flexible arm having a first bend portion that bends and extends upwards from the base portion, a second bend portion that bends from the first bend portion, a connection portion that extends from the second bend portion, and a contact portion located at the end of the connection portion;

wherein each of the receiving holes is defined by at least one inner wall, wherein at least one positioning portion is protruded from the at least one inner wall respectively;

wherein each pin includes a holding portion extended from one side of the base portion, and a transition portion is formed and bent in the side direction from one side of the holding portion that is close to the base portion;

wherein the transition portion is positioned with the at least one positioning portion to limit the relative movement of the pin in the receiving hole;

wherein the flexible arm of one pin is located above the flexible arm of another pin, and the contact portion of one pin is located above the second bend portion of another pin for two pins located in the same row and adjacent.

19. The electrical connector as claimed in claim 18, wherein the first bend portion bends and extends backwards from the base portion.

20. The electrical connector as claimed in claim 18, wherein the receiving holes are arranged in a plurality of rows, the receiving holes are arranged in a longitudinal direction and a transverse direction, and wherein the same row is the receiving holes arranged in the rows of said longitudinal direction.

* * * * *